US007252047B1

(12) United States Patent
Baucom, Jr.

(10) Patent No.: US 7,252,047 B1
(45) Date of Patent: Aug. 7, 2007

(54) WAVE-FORMING APPARATUS FOR BOATS

(76) Inventor: Donald L Baucom, Jr., 6131 Bull Head La., Florala, AL (US) 36442

( * ) Notice: Subject to any disclaimer, the term of this patent is extended or adjusted under 35 U.S.C. 154(b) by 108 days.

(21) Appl. No.: 11/230,991

(22) Filed: Sep. 20, 2005

(51) Int. Cl.
*B63B 1/22* (2006.01)
*E02B 3/00* (2006.01)

(52) U.S. Cl. ..... 114/284; 405/79

(58) Field of Classification Search ..... 144/284
See application file for complete search history.

(56) References Cited

U.S. PATENT DOCUMENTS 818,887 A * 4/1906 Hoeglauer
3,508,511 A * 4/1970 Bosnich
3,670,685 A * 6/1972 Milessa
3,847,104 A * 11/1974 Kaufer
4,008,677 A * 2/1977 Wordell, Sr.
4,057,027 A * 11/1977 Foster
4,406,162 A * 9/1983 Hark
4,443,202 A * 4/1984 Arena
4,553,945 A * 11/1985 Foster
5,664,910 A * 9/1997 Lochtefeld et al. ..... 405/79
5,860,766 A * 1/1999 Lochtefeld et al. ..... 405/79
5,988,092 A * 11/1999 Price
6,047,657 A * 4/2000 Cox ..... 114/242
6,105,527 A * 8/2000 Lochtefeld et al. ..... 114/125

FOREIGN PATENT DOCUMENTS

GB 1.159.269 * 5/1967
GB 1.592.451 * 7/1977
GB 2.028.746 * 3/1980
GB 2.033.324 * 5/1980

* cited by examiner

*Primary Examiner*—Jesus D. Sotelo
(74) *Attorney, Agent, or Firm*—Michael I Kroll

(57) ABSTRACT

An adjustable wake-forming apparatus attachable to a boat stern providing means for generating waves of a particular form for water sport activities. The attachment is comprised of a pair of blades fastened to the transom by a plurality of struts. The present invention provides for the use of the wave maker on boats having either an inboard or outboard engine. Each of the provided designs places the blades in a spaced away relationship to the engine propeller. Operatively, the blades have a top edge and curvilinearly diverging bottom edge with anterior and posterior ends linearly skewed causing a plow-like movement through the water.

10 Claims, 9 Drawing Sheets

WAVE-FORMING APPARATUS FOR BOATS

BACKGROUND OF THE INVENTION

1. Field of the Invention

The present invention relates generally to boats and, more specifically, to an adjustable wake-forming apparatus attachable to a boat stern providing means for generating waves of a particular form for water sport activities. The attachment is comprised of a pair of blades fastened to the transom by a plurality of struts. The present invention provides for the use of the wave maker on boats having either an inboard or outboard engine.

Each of the provided designs places the blades in a spaced away relationship to the engine propeller. Operatively, the blades have a top edge and curvilinearly diverging bottom edge with anterior and posterior ends linearly skewed causing a plow-like movement through the water.

The inboard engine design of the wavemaker is comprised of anteriorly hinged blades with struts serving as means for attachment to the boat stern, as well as means for effecting a wave form. A posteriorly fixed strut extends between the blades whereby the fore to aft blade skew angle can be varied. Extending from the opposing boat stern sides is a pair of struts, one over the other with the top ones incorporating means for varying the length while the bottom ones having a fixed length provide means for changing the blade pitch. Also extending between the boat stern and anterior blade top is a strut also incorporating length adjusting means whereby the blade depth can be changed.

The outboard engine wavemaker design is comprised of blades positioned on each side of the engine with struts serving as means for attachment, as well as means for effecting a wave form. A posteriorly fixed strut extends between the blades whereby the fore and aft blade skew angle can be varied. Mounted on opposing boat stern sides is a bracket having a threaded post with a pair of struts of fixed length mounted thereon, one over the other providing means for adjusting the depth of the blade relative to the water.

2. Description of the Prior Art

There are other devices designed for effecting a wave pattern. Typical of these is U.S. Pat. No. 818,887 issued to Hoeglauer on Apr. 24, 1906.

Another patent was issued to Bosnich on Apr. 28, 1970 as U.S. Pat. No. 3,508,511. Yet another U.S. Pat. No. 3,670,685 was issued to Milessa on Jun. 20, 1972 and still yet another was issued on Nov. 12, 1974 to Kaufer as U.S. Pat. No. 3,847,104.

Another patent was issued to Wordell, Sr. on Feb. 22, 1977 as U.S. Pat. No. 4,008,677. Yet another U.S. Pat. No. 4,057,027 was issued to Foster on Nov. 8, 1977. Another was issued to Hark on Sep. 27, 1983 as U.S. Pat. No. 4,406,162 and still yet another was issued on Apr. 17, 1984 to Arena as U.S. Pat. No. 4,443,202.

Another patent was issued to Foster on Nov. 19, 1985 as U.S. Pat. No. 4,553,945. Yet another U.S. Pat. No. 5,988,092 was issued to Price on Nov. 23, 1999. Another was issued to Buswell on Jul. 23, 1969 as U.K. Patent No. GB1,159,269 and still yet another was issued on Jul. 8, 1981 to Hark as U.K. Patent No. GB1592451. Another was issued to Buzzi, et al. on Mar. 12, 1980 as U.K. Patent No. GB2028746 and still yet another was issued on May 21, 1980 to Levi as U.K. Patent No. GB2033324.

U.S. Pat. No. 818,887

Inventor: Heinrich Hoeglauer

Issued: Apr. 24, 1906

The combination, with a bathtub, of means acting from opposite ends thereof directly upon the water therein to cause a bodily longitudinal movement of the water in opposite directions.

U.S. Pat. No. 3,508,511

Inventor: Angelo J. Bosnich

Issued: Apr. 28, 1970

An auxiliary stabilizing system for unpowered vessels comprising at least one vane (2, 2") attached to the vessel and located adjacent the vessel's bottom (3), said vane being a curved sheet of shape-holding material having an undulating horizontal cross-section forming generally an "S-curve" to define two vertically extending chambers, the first (4) opening toward one side of said vessel, and the second (4') opening toward the other side, whereby said vessel resists any sideward drift or leeway.

U.S. Pat. No. 3,670,685

Inventor: Aldo Milessa

Issued: Jun. 20, 1972

A vessel rudder consisting of a woven plastic water deflecting plate of a substantially trapezoid shape tensionally supported by a vertical slotted rod which is positioned in the center plane of the vessel's stern. A rudder stock is also positioned in the center plane. But aft of the vertical slotted rod a distance approximately equal to one fourth of the rudder plate's total maximum length. There is also fixed on the aft side another slotted rod supporting the back end of the woven plastic plate. And by turning the rudder stock plate it assumes a longitudinally curved shape for deflecting the water sideways.

U.S. Pat. No. 3,847,104

Inventor: Nicolaus Kaufer

Issued: Nov. 12, 1974

A single blade stern rudder having divergent side wall surfaces near the trailing edge to provide the part of the rudder blade of maximum cross-sectional width near the rudder trailing edge and remote from the rudder pivot axis. Such a rudder may be of the partly balanced type without a stationary stern post and may have a divergent-convergent cross-section away from the said divergent side wall surface region.

U.S. Pat. No. 4,008,677

Inventor: David Hazard Wordell, Sr.

Issued: Feb. 22, 1977

A transom mounted retractible rudder for sailboats or other small vessels. A rudder blade is pivotally mounted on a lower portion of a rudder stock. By means of a handle located adjacent the stern of the boat and connected through a linkage to the rudder blade, a crew member can raise and lower the rudder blade between a fully retracted position and a fully extended position. The handle and a dial on the rudder stock cooperate to provide an indication of the attitude and depth of the rudder blade at any given time.

U.S. Pat. No. 4,057,027

Inventor: Daniel S. Foster

Issued: Nov. 8, 1977

A vee bottom boat having one or two inboard engines with the drive shafts thereof extending through the hull to position a propeller in a position such that when the boat is planing at cruising speed the propeller will be surface-running or operating in half-submerged condition. A rudder is located directly in rear of the propeller. A partly cylindrical splash guard is provided over the propeller and prevents "rooster-tailing." In addition, a water supply duct having a radius approximating that of the propeller is provided extending forwardly a short distance from the propeller. A transmission connecting the engine to a propeller shaft includes a chain which permits advantageous location of the propeller shaft relative to the engine and its output shaft.

U.S. Pat. No. 4,406,162

Inventor: William B. Hark

Issued: Sep. 27, 1983

An apparatus for creating surface waves in a body of liquid is disclosed which comprises a liquid displacer, a motor and a linear actuator for imparting movement to the displacer, and a level sensing device cooperating with the liquid displacer to control liquid level through control of wave generation. The present apparatus is able to adjust liquid activity to accommodate extraneous wave patterns, and to thereby more accurately control the exact wave patterns generated. The present apparatus is useful for performing wave testing to simulate aquatic conditions for ships, oil rigs and harbor installations.

U.S. Pat. No. 4,443,202

Inventor: Daniel J. Arena

Issued: Apr. 17, 1984

A unitary assembly (10) for mounting a surface propeller (52) on the transom (T) of a boat hull (H). The assembly comprises a plate (12) for attachment to the hull (H); a prop shaft support (16) fixed to the plate (12) for juxtaposition against the transom (T); and, a rudder support arm (20) fixed to the plate (12) and extending rearwardly therefrom above and in spaced relationship to the shaft support (16). As a result of its unitary construction, the assembly provides for ready attachment of a surface prop to a hull without major hull modification or the necessity of aligning separate shaft bearing supports and rudder elements. In its preferred embodiment, the assembly also includes a propeller hood supported by the arm and a spray deflector at the aft end of the hood.

U.S. Pat. No. 4,553,945

Inventor: Daniel S. Foster

Issued: Nov. 19, 1985

A safety shroud for attachment to the rear surface of the transom of an unmodified boat hull equipped with an inboard engine and a propeller tube and shaft rigidly fixed to the engine and extending with clearance through an enlarged opening in the transom, and a propeller on the shaft; the shroud being longitudinally and transversely downward concave to overlie the top and partly enclose the sides of the propeller, the shroud in longitudinal section being upwardly and rearwardly curved from the forward bottom edge of the shroud to just ahead of the propeller zone and then extending straight rearwardly. The lateral edges of the shroud extend generally upwardly and rearwardly from the forward bottom edge of the shroud to merge with the top rear edge thereof. Preferably the shroud is composed of inner and outer interconnected plastic shells, the outer shell having a downward concave reinforcing strut, closed at its bottom by the inner shell, and having a metal rudder support shaft therein. The shroud and boat together constitute a new and improved combination.

U.S. Pat. No. 5,988,092

Inventor: Harold L. Price

Issued: Nov. 23, 1999

The vessel of this invention has a relatively uniform weight distribution throughout the length of the vessel which maintains a level trim under all operation conditions thereby maximizing the efficiency of the design and operation. This is, in part, accomplished by locating the engine and major transmission drive components inboard of the boat rather than outboard astern, and by locating the operator and the rudder assembly at the bow of the boat. Unique features of the invention include the propulsion and steering systems for a boat consisting of a paddle wheel, a power supply, a clutch, a gear reduction system to transfer and reverse power to the paddle wheel, an optional splash guard mounted between the stern of the boat and the paddle wheel, a frame to attach the propulsion members to the boat and a rudder assembly mounted to the bow of the boat. The paddle wheel can include blades to effect vertical lift secured to angled spokes at an angle radially, inclined or skewed to the axis of rotation of the paddle wheel rather than extending radially from the axis of rotation of the center hubs. The steering system includes the rudder assembly mounted at the bow of the boat and being formed and arranged to pivot freely about a horizontal axis in a vertical direction as well as having a rudder blade which pivots about a vertical axis.

U.K. Patent Number GB1,159,269

Inventor: Richard Bobart Buswell

Issued: Jul. 23, 1969

The invention relates to apparatus for simulating water skiing by establishing a fast-moving fluid surface under a stationary water-skier. As shown, the apparatus comprises a tank 1 to which water is delivered both upwardly and horizontally by pumps 12, 13 and a distributor pipe 15. The water passes over a weir 7 at the other end of the tank and is returned to the pumps via passage 10. The skier holds on to a conventional tow rope secured to a fixed anchorage at or beyond the end of the tank. The tank may be charged with water containing entrained air.

U.K. Patent Number GB1592451

Inventor: William Brian Hark

Issued: Jul. 8, 1981

Disclosed is an apparatus for creating surface waves in a body of liquid, comprising a liquid displacer, means for moving the liquid displacer back and forth to create the waves in the body of liquid, and means for sensing the level of the body of liquid, for producing a signal representative of the level of the liquid in the region of the displacer and for controlling the means for moving the liquid displacer in dependence upon said signal so as to cause reflected waves to be dissipated at or absorbed by the displacer.

U.K. Patent Number GB2028746

Inventor: Fabio Buzzi, et al.

Issued: Mar. 12, 1980

A drive for a watercraft comprises a surface propeller 8 which is driven by an inboard motor by way of a shaft assembly which extends through the transom 28 and is jointed at least in the region of the transom; the outboard propeller shaft is journalled in a support arm 2 with a forward flange plate 27, fitted to the transom on the outboard side, such that the propeller thrust is transferred directly from a propeller thrust bearing in the support arm to the watercraft. The support arm 2 is a one-piece structure in the form of box sections 3, 4 which in addition to the propeller shaft bearings also house connections for cooling water lines, the exhaust gas duct, and operating elements for a steering rudder 31 fitted aft of the propeller, and also carries a trimming rudder 38 which can be swiveled about a horizontal axis. A change-over and/or reversing gear can be provided inside the watercraft, or between the transom and support arm, or inside the support arm.

U.K. Patent Number GB2033324

Inventor: Renato Levi

Issued: May 21, 1980

A drive unit for a water craft includes a surface propeller (25) and can be affixed to the transom of a craft of conventional design with the propeller shaft (22) inclined at an angle of no more than 10 DEG with the running lines of the craft and the propeller aft of the transom by between 5% and 15% of the overall length of the craft. The unit may include single or double tunnel rudders and may support an engine driving the propeller shaft.

While these devices may be suitable for the purposes for which they were designed, they would not be as suitable for the purposes of the present invention, as hereinafter described.

SUMMARY OF THE PRESENT INVENTION

A primary object of the present invention is to provide means for generating a desired wave form behind a boat.

Another object of the present invention is to provide means for varying the wave form behind said boat Yet another object of the present invention is to provide means for attaching said wave forming apparatus to a boat having an inboard or out board engine.

Still yet another object of the present invention is to provide a wave forming device comprised of divergent curvilinear blades.

Another object of the present invention is to provide a wave forming device having struts extending from the boat stern to the wave forming device.

Yet another object of the present invention is to provide a wave forming device that is pitch adjustable.

Still yet another object of the present invention is to provide a wave forming device that is vertically adjustable.

Additional objects of the present invention will appear as the description proceeds.

The present invention overcomes the shortcomings of the prior art by providing an adjustable wave-forming apparatus attachable to a boat stern providing means for generating waves of a particular form for water sport activities.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
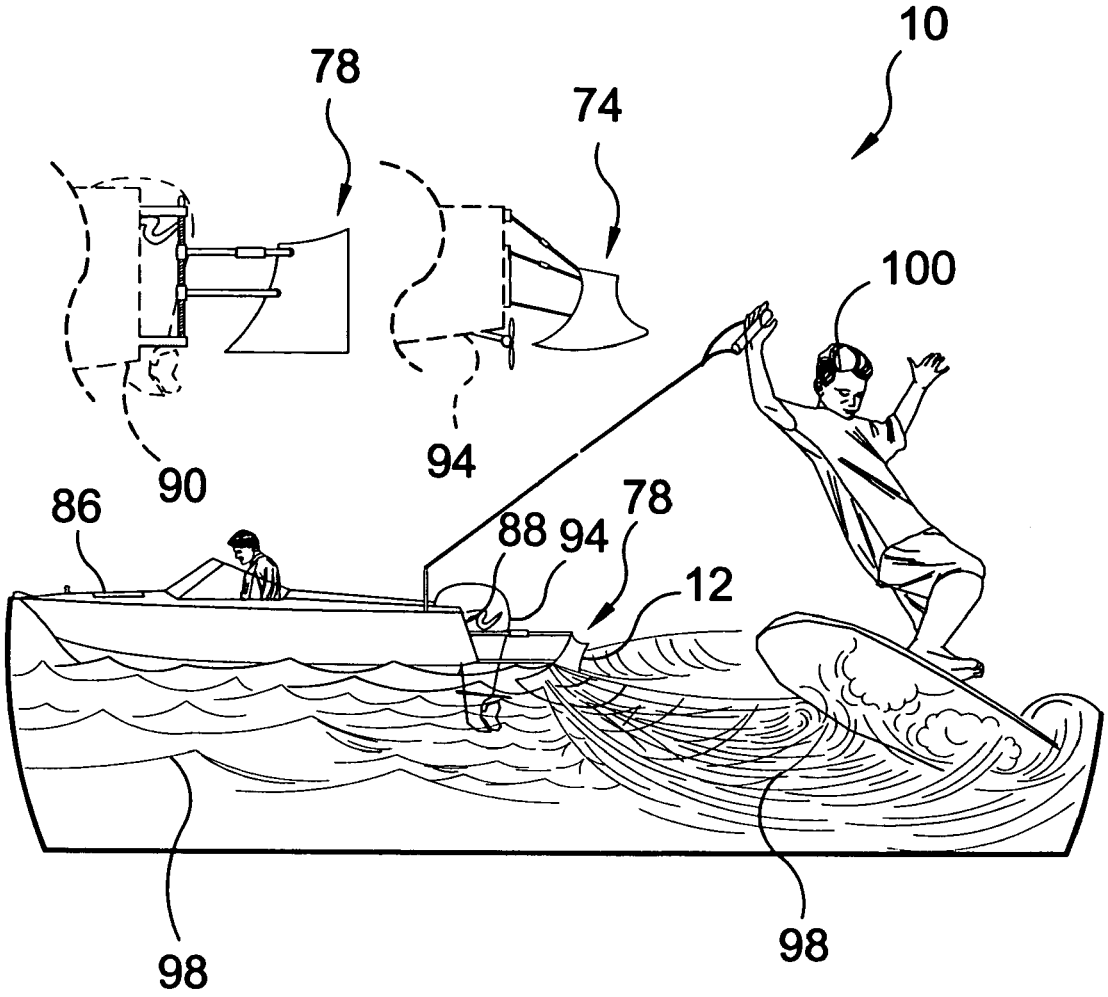
FIG. 1 is an illustrative view of the present invention.

Turning now descriptively to the drawings, in which similar reference characters denote similar elements throughout the several views, the figures illustrate the Wave-Forming Apparatus of the present invention of the present invention. With regard to the reference numerals used, the following numbering is used throughout the various drawing figures.

| | |
|---|---|
| 10 | Wave-Forming Apparatus of the present invention |
| 12 | wave-maker |
| 14 | blade member |
| 16 | first blade member |
| 18 | second blade member |
| 20 | anterior end of 14 |
| 22 | posterior end of 14 |
| 24 | wave adjustment strut |
| 26 | first post of 24 |
| 28 | first end of 26 |
| 30 | second end of 26 |
| 32 | second post of 24 |
| 34 | first end of 32 |
| 36 | second end of 32 |
| 38 | turnbuckle |
| 40 | fixed strut |
| 42 | first post of 40 |
| 44 | first end of 42 |
| 46 | second end of 42 |
| 48 | second end of 42 |
| 50 | pitch adjustment strut |
| 52 | first post of 50 |
| 54 | first end of 52 |
| 56 | second end of 52 |
| 58 | depth adjusting means |
| 60 | height adjusting strut |
| 62 | first post of 60 |
| 64 | first end of 64 |
| 66 | second end of 64 |
| 68 | second post of 60 |
| 70 | first end of 68 |
| 72 | second end of 68 |
| 74 | inboard wave-maker |
| 76 | hinge |
| 78 | outboard wave-maker |
| 80 | threaded vertical tube |
| 82 | threaded rod |
| 84 | support member |
| 86 | boat |
| 88 | transom of 86 |
| 90 | inboard engine |
| 92 | propulsion unit of 90 |
| 94 | outboard engine |
| 96 | water |
| 98 | wave |
| 100 | user |
| 102 | second post of 50 |
| 104 | first end of 102 |
| 106 | second end of 102 |

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10. The present invention 10 is an adjustable wave-forming apparatus 10 that is mounted on the transom 88 of a boat 86 for creating a predetermined wave pattern 98 for water sports. The wave-forming apparatus 10 comprises a wave-maker 12 fastened to the transom 88 by a plurality of struts. The present invention 10 has an inboard wave-maker 74 and an outboard wave-maker 78 so it can be adapted for use on boats 88 having either an inboard 90 or outboard 94 engine.

Figure 2:
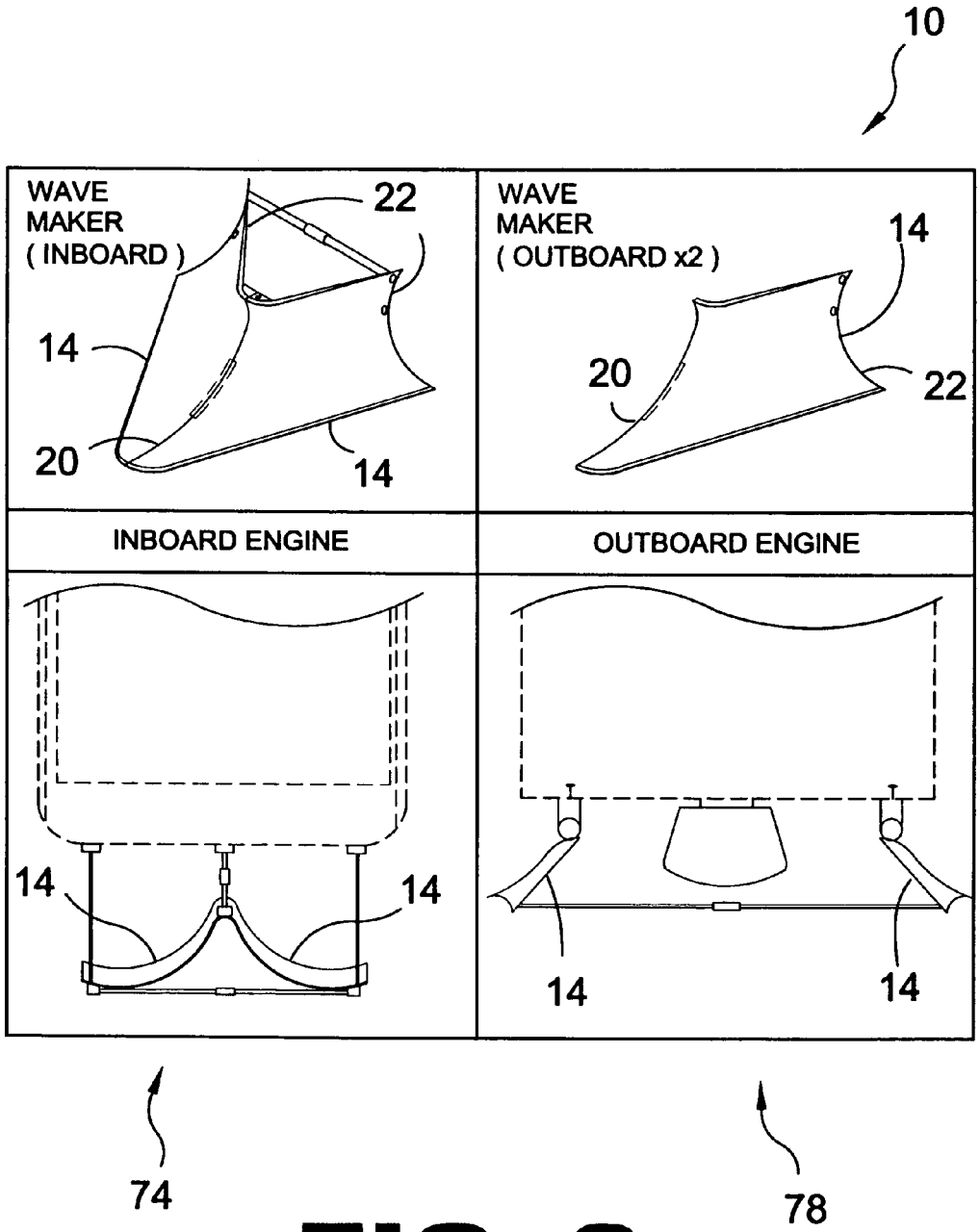
FIG. 2 is an illustrative view of the present invention for inboard and outboard engines.

FIG. 2 is an illustrative view of the present invention 10 for inboard 74 and outboard 78 engines. As illustrated, a pair of blade members 14 are positioned at the stern to effect a predetermined wave pattern that can be used in water sport activities. Each of the provided designs places the blade members 14 in a spaced away relationship to the engine propeller. Operatively, the blades have a top edge and curvilinearly diverging bottom edge with anterior 20 and posterior 22 ends linearly skewed causing a plow-like movement through the water.

Figure 3:
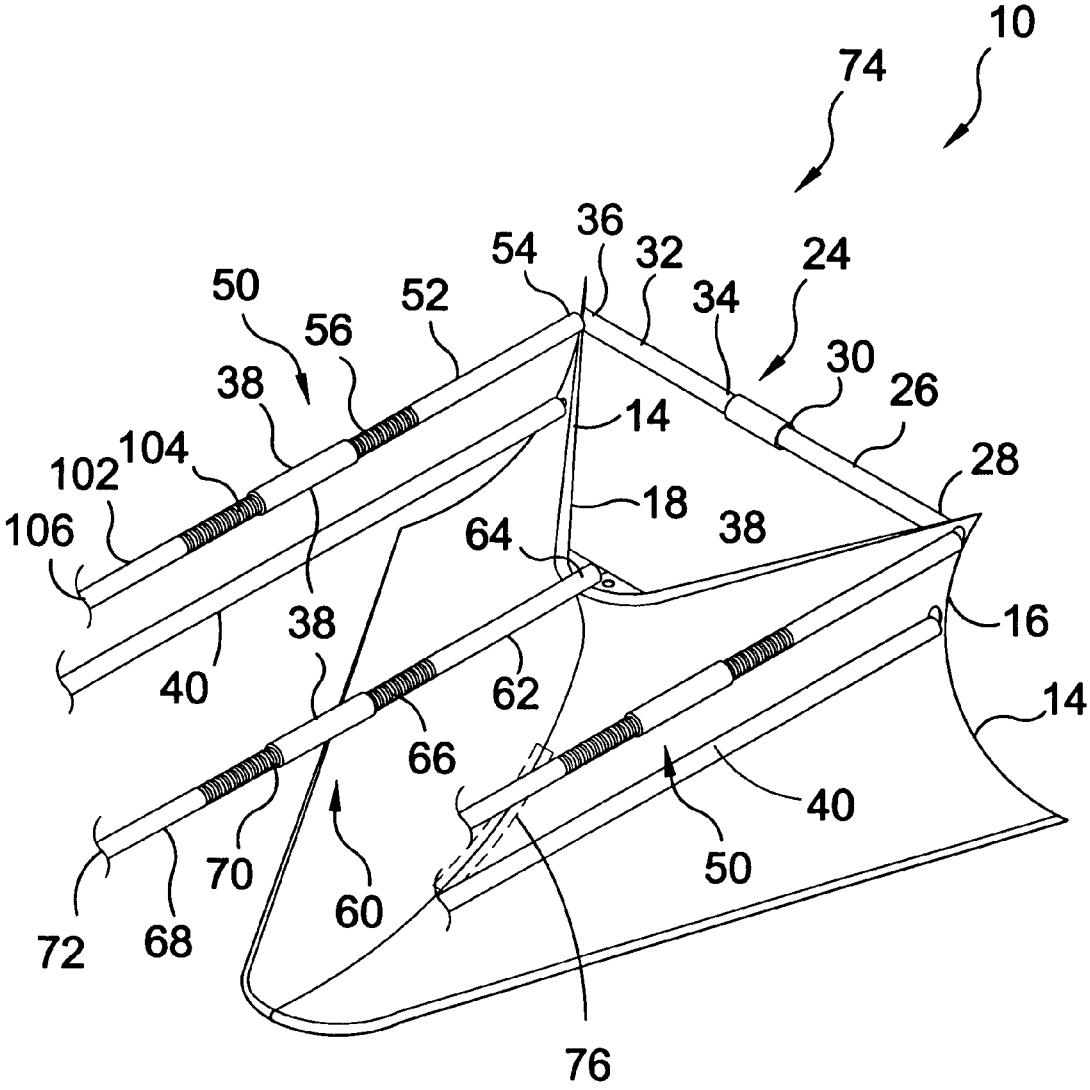
FIG. 3 is a perspective of an inboard engine wavemaker.

FIG. 3 is a perspective of an inboard engine wavemaker 74. Shown is the inboard engine design of the wavemaker 74 comprising anteriorly hinged 76 blades 14 with struts serving as means for attachment to the boat stern, as well as means for effecting a wave form. An anteriorly positioned wave adjustment strut 24 extends between the first blade member 16 and the second blade member 18 whereby the fore and aft blade skew angle can be varied. The wave adjustment strut 24 comprises a first post 26 having a first end 28 affixed to the aft posterior end 22 of the first blade member 16 and a second threaded end 30 screwed into a turnbuckle 38 and a second post 32 having a first threaded end 34 threaded into the turnbuckle 38 and a second end 36 affixed to the aft posterior 22 end of said second blade member 18. Extending from each opposing boat stern side is a pair of struts, a pitch adjustment strut 50 disposed over a fixed strut 40 with the pitch adjustment strut 50 incorporating means for varying the length while the fixed strut 40 has a fixed length providing means for changing the blade 14 pitch. The fixed struts 40 associated with each blade member 14 are affixed to the posterior ends 22 of said blade members 14 and to the transom of a boat. The pitch adjustment strut 50 associated with each blade member 14 is disposed superjacent to the fixed strut 40 and comprises a first post 52 having a first end 54 affixed to the posterior end 22 of the blade member 14 and a second threaded end 56 screwed into a turnbuckle 38 and a second post 102 having a first threaded end 104 threaded into a the turnbuckle 38 and a second end 106 affixed to the transom of a boat. Also extending between the boat stern and anterior 20 blade top is a height-adjusting strut 60 also incorporating length adjusting means whereby the blade depth can be changed. The height adjustment strut 60 comprises a first post 62 having a first end 64 affixed to a central superior anterior portion of said wave-maker 12 and a second threaded end 66 screwed into a turnbuckle and a second post 68 having a first threaded end 70 and a second end 72 affixed to the transom of a boat on a horizontal plane superior to the transom connection points of said pitch adjustment struts 50.

Figure 4:
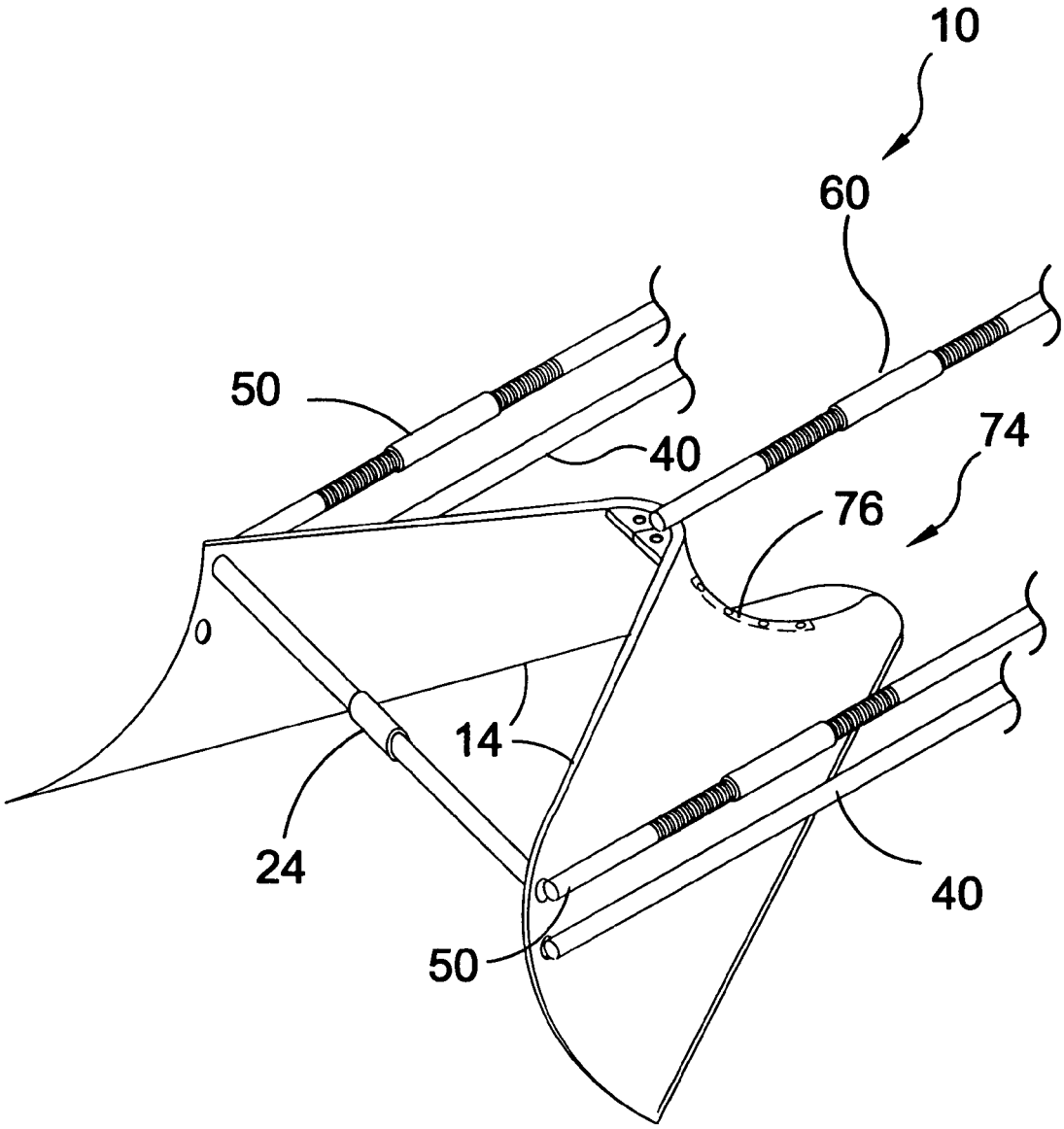
FIG. 4 is a perspective of the posterior side of the present invention.

FIG. 4 is a perspective of the posterior side 22 of the present invention 10. Shown is an aft view of the inboard wavemaker 74 comprising anteriorly hinged 76 blades 14 with fixed 40 and pitched adjustment 50 struts serving as means for attachment to the boat stern, as well as means for effecting a wave form. A posteriorly disposed wave adjustment strut 24 extends between the blades 14 whereby the fore and aft blade skew angle can be varied. A height adjustment strut 60 allows the submersion depth of the wave-maker 74 to be adjusted accordingly.

Figure 5:
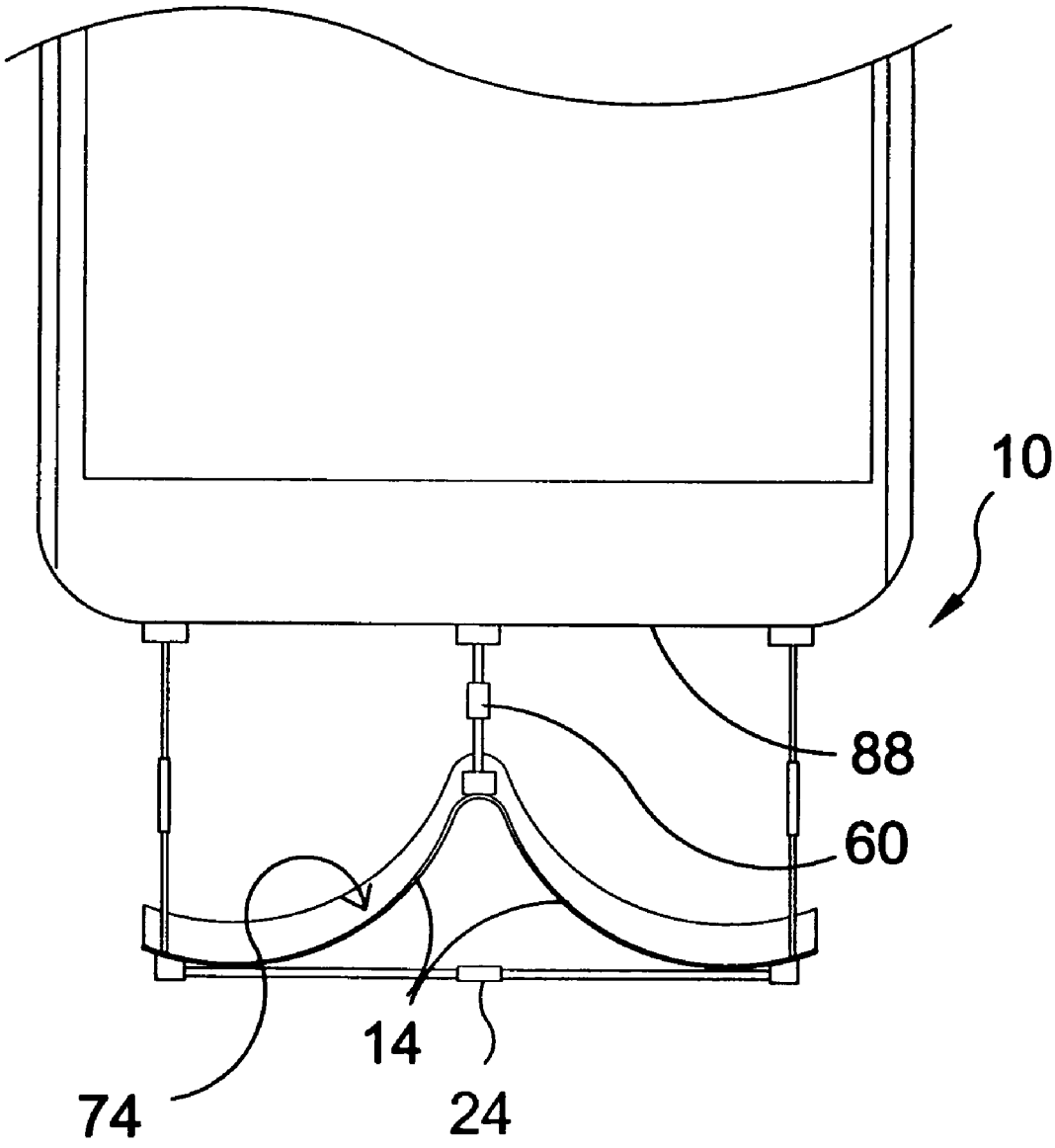
FIG. 5 is a top view of the present invention for inboard engine boats.

FIG. 5 is a top view of the present invention 10 for inboard engine boats. Shown is a top view of the inboard engine wavemaker 74 design having anteriorly hinged blades 14 with struts serving as means for attachment to the boat transom 88, as well as means for effecting a wave form. A posteriorly fixed wave adjustment strut 24 extends between the blades 14 whereby the fore and aft blade skew angle can be varied. Extending from the opposing boat stern sides are a pair of struts, one over the other with the top ones incorporating means for varying the length while the bottom ones having a fixed length provide means for changing the blade 14 pitch. Also extending between the boat stern and anterior blade top is a height adjusting strut 60 also incorporating length adjusting means whereby the blade 14 depth can be changed.

Figure 6:
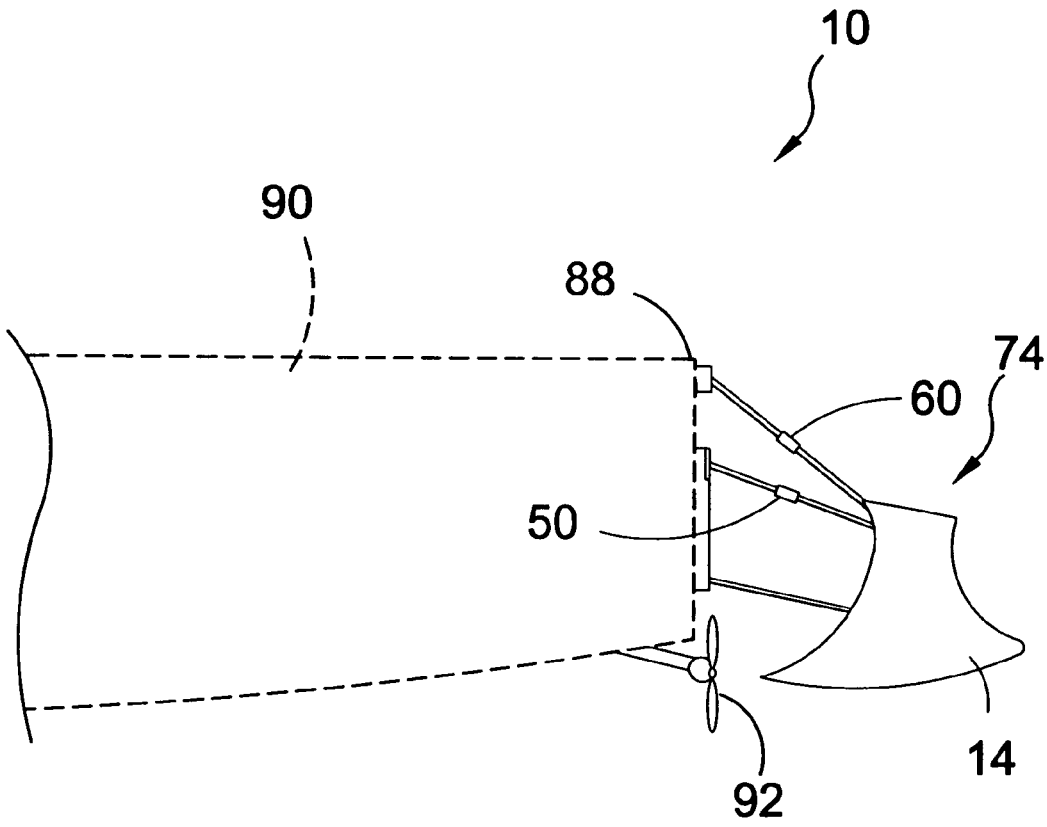
FIG. 6 is a side view of the present invention for inboard engine boats.

FIG. 6 is a side view of the present invention 10 with inboard engine wavemaker 74. Shown is a side view of the inboard engine wavemaker 74 disposed behind the propulsion unit 92 of the inboard engine 90. Shown is a side view of the inboard wavemaker 74 comprising anteriorly hinged blades 14 with fixed 40 and pitched adjustment 50 struts serving as means for attachment to the boat transom 88, as well as means for effecting a wave form. A posteriorly disposed wave adjustment strut extends between the blades 14 whereby the fore and aft blade skew angle can be varied. A height adjustment strut 60 allows the submersion depth of the wave-maker 74 to be adjusted accordingly.

Figure 7:
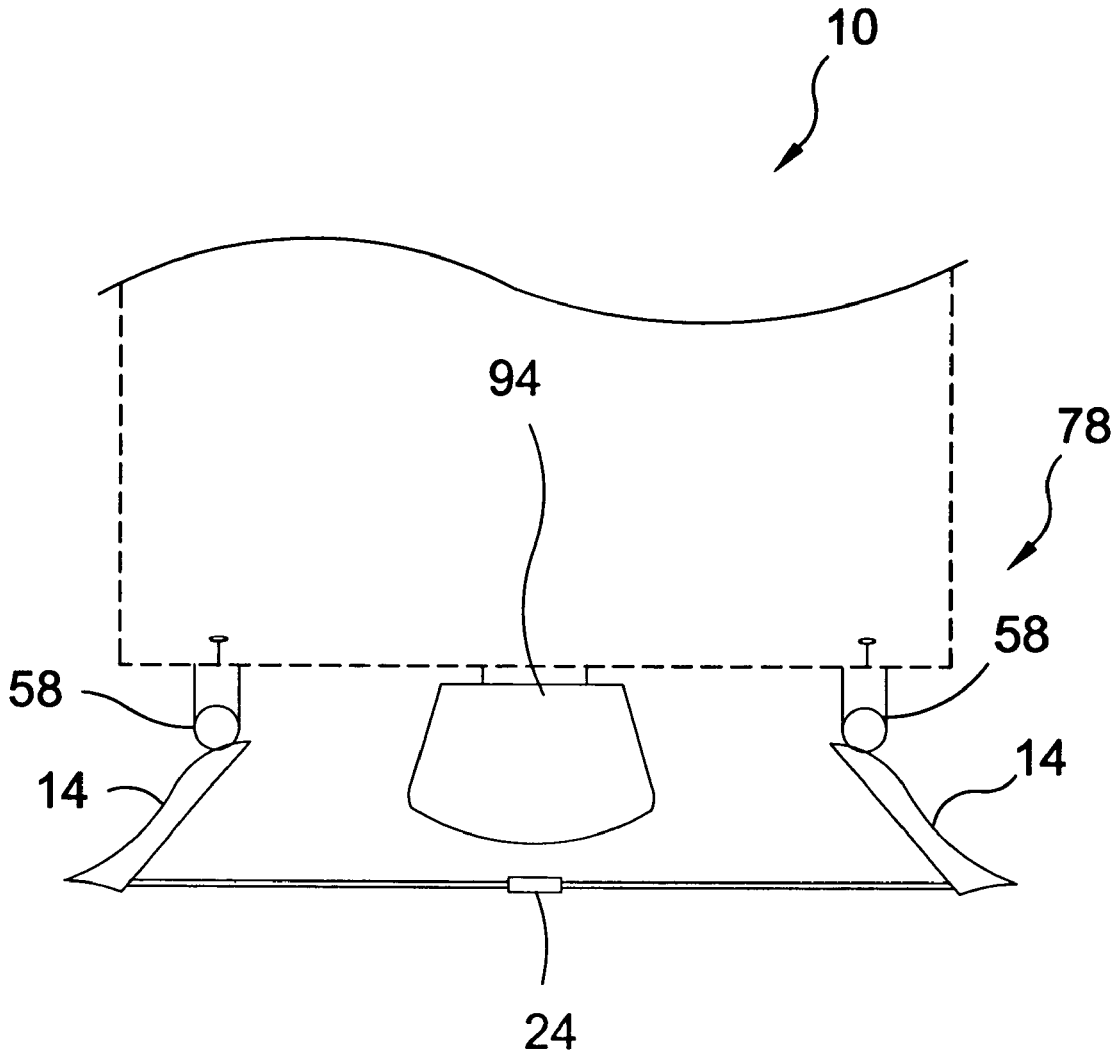
FIG. 7 is a top stern view of the wavemaker design for boats with an outboard engine.

FIG. 7 is a top stern view of the outboard wave-maker 78 design of the present invention 10 for boats with an outboard engine 94. Shown is a top view of the outboard engine wave-maker 78 design comprising blades 14 positioned on each side of the engine 94 with struts serving as means for attachment, as well as means for effecting a wave form. A posteriorly fixed wave adjustment strut 24 extends between the blades 14 whereby the fore and aft blade 14 skew angle can be varied. Mounted on opposing boat stern sides is a bracket having a threaded post with a pair of struts of fixed length mounted thereon, one over the other providing a depth adjustment means 58 for adjusting the depth of the blade 14 relative to the water.

Figure 8:
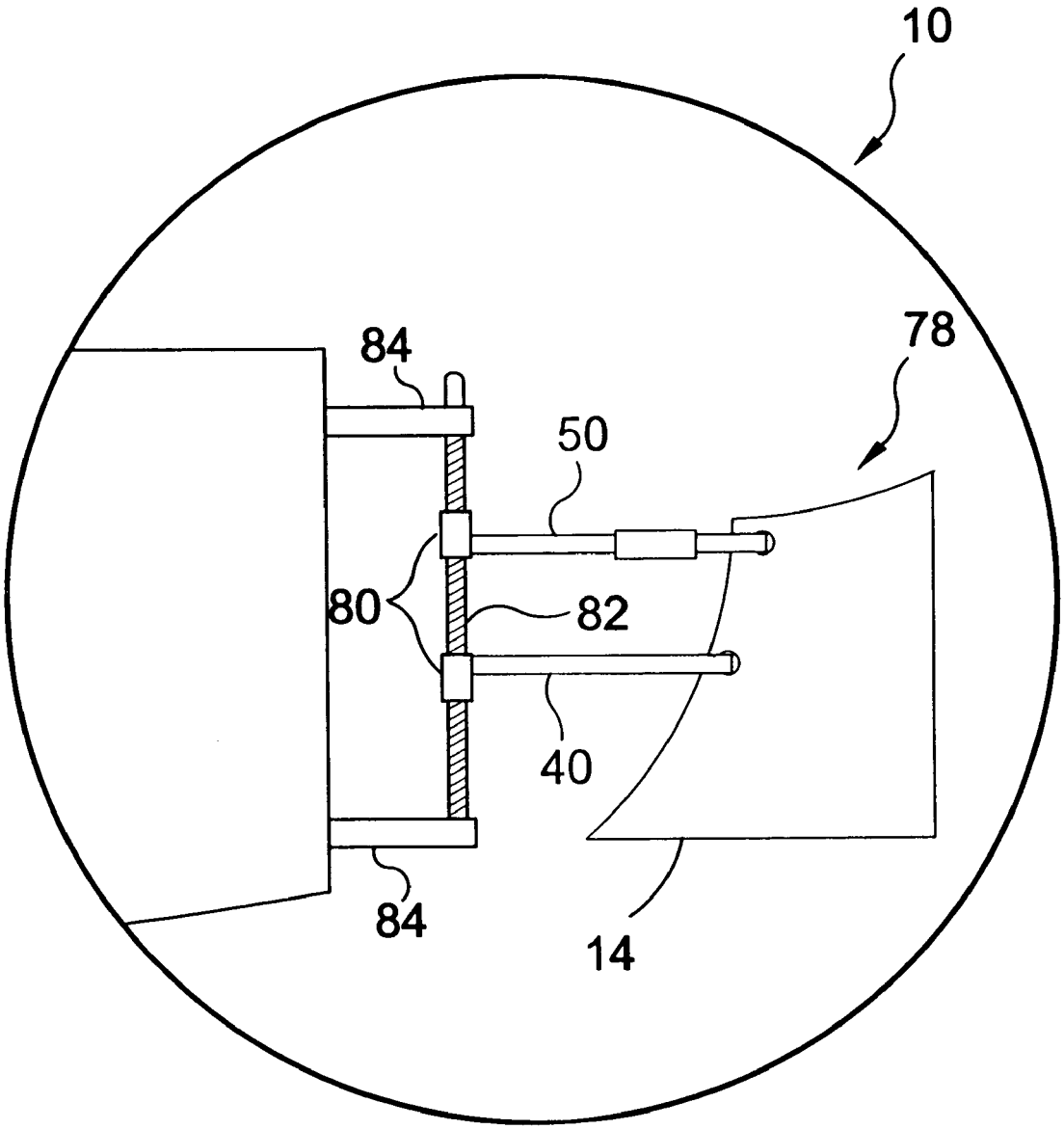
FIG. 8 is a side view of the mounting components of the wavemaker design for boats with an outboard engine.

FIG. 8 is a side view of the mounting components of the outboard wave-maker 78 design of the present invention 10 for boats with an outboard engine. Shown is a side view of the outboard engine wavemaker 78 design comprising blades 14 positioned on each side of the engine with fixed struts 40 and pitch adjustment struts 50 serving as means for attachment having distally disposed threaded vertical tubes 80, as well as means for effecting a wave form. A posteriorly fixed strut extends between the blades 14 whereby the fore and aft blade skew angle can be varied. Mounted on opposing boat stern sides is a bracket having a threaded rod 82 with a pair of support members 84 of fixed length mounted thereon, one over the other providing means for adjusting the depth of the blade 14 relative to the water.

Figure 9:
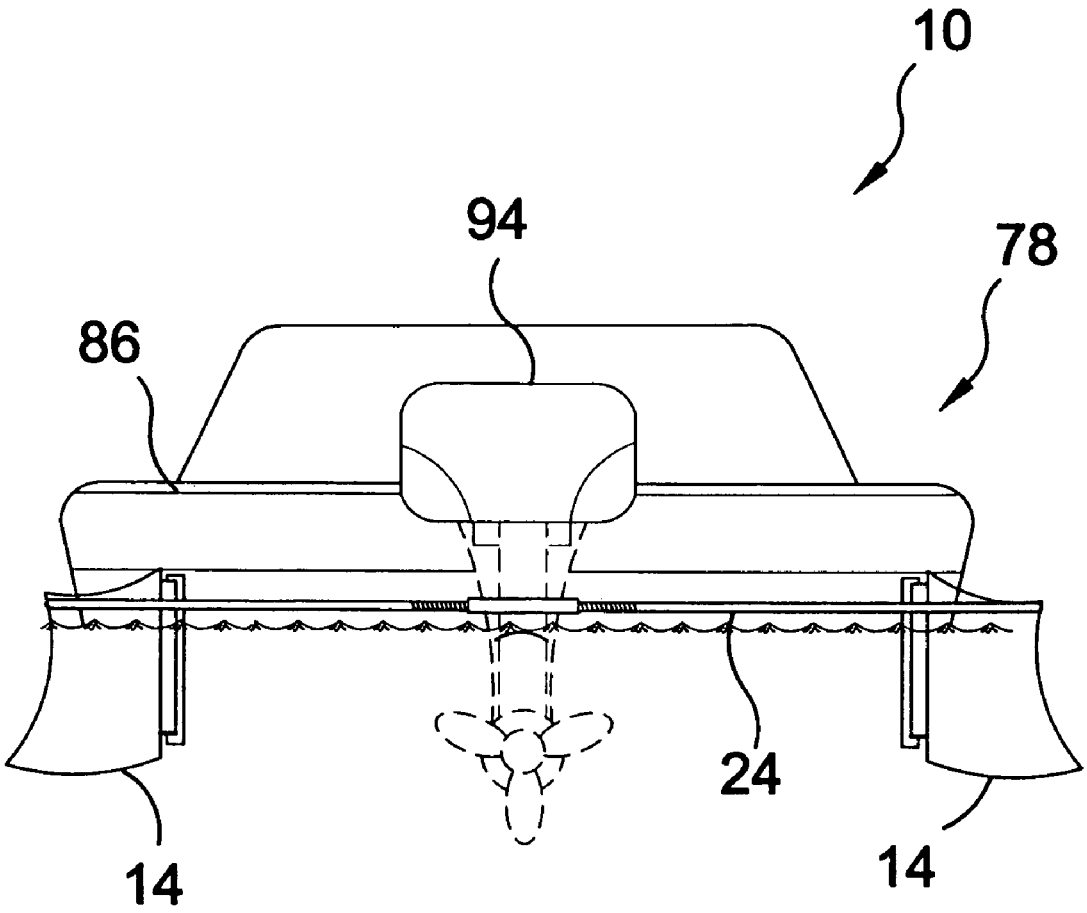
FIG. 9 is a stern view of the present invention for outboard engine boats.

FIG. 9 is a stern view of the outboard wave-maker 78 of the present invention 10 for outboard engine 94 boats 86 comprising blades 14 positioned on each side of the engine 94 with struts serving as means for attachment, as well as means for effecting a wave form. A posteriorly fixed wave adjustment strut 24 extends between the blades 14 whereby the fore and aft blade skew angle can be varied. Mounted on opposing boat stern sides is a bracket having a threaded post with a pair of struts of fixed length mounted thereon, one over the other providing means for adjusting the depth of the blade relative to the water.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by letters patent is set forth in the appended claims.

The invention claimed is:

1. A wave-forming apparatus for boats for generating various desired wave forms in the wake of said boat comprising:

a) a wave-maker comprising a first angular, curved blade member and a second opposing angular, curved blade member, each having a top edge and a curvilinearly diverging bottom edge with the anterior and posterior ends linearly skewed to work conjunctively to perform a plow-like function as they move through the water to generate various wave forms;

b) a wave adjustment strut comprising:

i) a first post having a first end affixed to the aft posterior end of said first blade member and a second threaded end;

ii) a second post having a first threaded end and a second end affixed to the aft posterior end of said second blade member; and iii) an adjustment turnbuckle screwed onto said threaded end of said first post and said threaded end of said second post whereby the length of said wave adjustment strut may be adjusted accordingly as determined by the direction in which said turnbuckle is rotated;

c) a fixed strut associated with each said blade member, each fixed strut having a first end and a second end wherein said first end is affixed to said posterior end of said blade member and said second end affixed to the transom of a boat;

d) a pitch adjustment strut associated with each said blade member, each said adjustment strut disposed superjacent to said fixed strut and comprising:

i) a first post having a first end affixed to said posterior end of said blade member and a second threaded end;

ii) a second post having a first threaded end and a second end affixed to the transom of a boat; and iii) an adjustment turnbuckle screwed onto said threaded end of said first post and said threaded end of said second post whereby the length of said wave adjustment strut may be adjusted accordingly as determined by the direction in which said turnbuckle is rotated; and e) depth adjusting means for adjusting the depth of said blade members relative to the water.

2. A wave-forming apparatus for boats as recited in claim 1, wherein said apparatus can be installed in boats with inboard engines.

3. A wave-forming apparatus for boats as recited in claim 2, wherein the configuration for boats with inboard engines comprises:

a) said blade members adjacent to one another and hingedly connected at the fore position of said wave-maker to form a single unit;

b) said wave-maker being disposed directly behind and spaced apart from the propulsion source of the engine of the boat; and c) said depth adjustment means being a height adjustment strut centrally positioned on the transom comprising:

i) a first post having a first end affixed to a central superior, anterior portion of said wave-maker and a second threaded end;

ii) a second post having a first threaded end and a second end affixed to the transom of a boat on a horizontal plane superior to the transom connection points of said pitch adjustment struts; and iii) an adjustment turnbuckle screwed onto said threaded end of said first post and said threaded end of said second post whereby the length of said height adjustment strut may be adjusted accordingly as determined by the direction in which said turnbuckle is rotated.

4. A wave-forming apparatus for boats as recited in claim 3, wherein the pitch of said wave-maker is manually adjusted by rotating said turnbuckles of said pitch adjustment struts to establish the desired pitch of said wave-maker.

5. A wave-forming apparatus for boats as recited in claim 4, wherein the height of said wave-maker is manually adjusted by rotating said turnbuckle of said height adjustment strut to achieve the desired depth of said wave-maker relative to the water.

6. A wave-forming apparatus for boats as recited in claim 5, wherein the wave form generated by said wave-maker is adjusted by rotating said turnbuckle of said wave adjustment strut wherein the lengthening thereof results in increasing the separation of the posterior portions of said blade members which pivot on said hinge.

7. A wave-forming apparatus for boats as recited in claim 1, wherein said apparatus can be installed in boats with outboard engines.

8. A wave-forming apparatus for boats as recited in claim 7, wherein said configuration for boats with outboard engines comprises:

a) said wave-maker having said blade members in spaced apart relation with one another, said first blade member is disposed on one side of the outboard engine and said opposing second blade member is disposed on the other; and b) a depth-adjusting means wherein each said blade member is secured to the transom by a height adjuster comprising:

i) an interiorly-threaded vertical tube integral with said second end of said fixed strut;

ii) an interiorly-threaded vertical tube integral with said second end of said second post of said pitch adjustment strut; and iii) a threaded vertical rod secured to said transom by a pair of support members.

9. A wave-forming apparatus for boats as recited in claim 8, wherein said vertical tubes are threaded onto said vertical rod and travel therealong accordingly depending upon the direction in which said vertical rod is rotated to raise and lower said blade members as necessary.

10. A wave-forming apparatus for boats as recited in claim 9, wherein the combination of settings for said depth adjustment means, said pitch adjustment struts and said wave adjustment strut determine the wave that will be generated thereby, thus providing the user with a multitude of variations of potential wave forms.

* * * * *